US007183982B2

(12) United States Patent
Kadambi et al.

(10) Patent No.: US 7,183,982 B2
(45) Date of Patent: Feb. 27, 2007

(54) OPTIMUM UTILIZATION OF SLOT GAP IN PIFA DESIGN

(75) Inventors: Govind Rangaswamy Kadambi, Lincoln, NE (US); Willis Raymond Hardy, Lincoln, NE (US); Sripathi Yarasi, Lincoln, NE (US); Theodore Samuel Hebron, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 63 days.

(21) Appl. No.: 10/605,593

(22) Filed: Oct. 10, 2003

(65) Prior Publication Data

US 2004/0104851 A1 Jun. 3, 2004

Related U.S. Application Data

(60) Provisional application No. 60/424,850, filed on Nov. 8, 2002.

(51) Int. Cl.
*H01Q 1/24* (2006.01)

(52) U.S. Cl. ..... 343/702; 343/700 MS

(58) Field of Classification Search ..... 343/700 MS, 343/746, 767, 895, 795, 702
See application file for complete search history.

(56) References Cited

U.S. PATENT DOCUMENTS

| | | | | |
|---|---|---|---|---|
| 5,649,350 | A * | 7/1997 | Lampe et al. | 29/600 |
| 5,754,143 | A * | 5/1998 | Warnagiris et al. | 343/767 |
| 5,764,190 | A | 6/1998 | Murch et al. | 343/702 |
| 6,295,030 | B1 | 9/2001 | Kozakai et al. | 343/700 MS |
| 6,346,914 | B1 | 2/2002 | Annamaa | 343/700 MS |
| 6,366,243 | B1 * | 4/2002 | Isohatala et al. | 343/700 MS |
| 6,380,895 | B1 | 4/2002 | Moren et al. | 343/700 |
| 6,380,905 | B1 * | 4/2002 | Annamaa et al. | 343/767 |
| 6,466,169 | B1 * | 10/2002 | Harrell et al. | 343/700 MS |

(Continued)

FOREIGN PATENT DOCUMENTS

EP 1 128 466 A2 8/2001

(Continued)

OTHER PUBLICATIONS

International Searching Authority "Notification of Transmittal of the International Search Report or the Declaration".

(Continued)

*Primary Examiner*—Trinh Dinh
*Assistant Examiner*—Huedung Mancuso
(74) *Attorney, Agent, or Firm*—Holland & Hart LLP

(57) ABSTRACT

Operating parameters of a planar antenna are controlled by providing a planar metal radiating element having an edge, by providing a slot within the radiating element, the slot having side walls, an open slot-end that lies on the edge of the radiating element, and a closed slot-end the lies within the radiating element, and by providing a thin, line-like, and metal segment, at least a portion of which is coplanar with the radiating element and that extends from the open slot-end to the closed slot-end without physically engaging the slot's side walls. The metal segment can be connected to the antenna's ground plane to thereby form a parasitic element, or the metal segment can be connected to the radiating element to thereby form an extension of the radiating element.

27 Claims, 4 Drawing Sheets

U.S. PATENT DOCUMENTS

| | | | | |
|---|---|---|---|---|
| 6,573,869 | B2 | 6/2003 | Moore | 343/702 |
| 2002/0190905 | A1* | 12/2002 | Flint et al. | 343/702 |
| 2004/0001021 | A1* | 1/2004 | Choo et al. | 343/700 MS |

FOREIGN PATENT DOCUMENTS

| | | | |
|---|---|---|---|
| EP | A 1 128 466 | | 8/2001 |
| EP | 1 241 733 | A1 | 9/2002 |
| EP | A 1 241 733 | | 9/2002 |
| WO | WO 02/43182 | A | 5/2002 |
| WO | WO 02/43182 | A1 | 5/2002 |
| WO | WO 02/075853 | A | 9/2002 |
| WO | WO 02/075853 | A1 | 9/2002 |

OTHER PUBLICATIONS

International Preliminary Examining Authority, "Notification of Transmittal of International Preliminary Examination Report", Oct. 3, 2005.

Salonen Pe et al. "New Slot Configurations for Dual-Band Planar Invented F-Antenna" Microwave and Optical Technology Letters, John Wiley, New York, NY, US, vol. 28, No. 5, Jan. 23, 2001.

European Communication Pursuant to Article 96 (2) EPC, Feb. 10, 2006.

European Search Report; Nov. 18, 2005.

Microwave and Optical Technology Letters/ vol. 28, No. 5, Mar. 5, 2001 pp. 293-298.

* cited by examiner

OPTIMUM UTILIZATION OF SLOT GAP IN PIFA DESIGN

CROSS REFERENCE TO RELATED APPLICATIONS

This non-provisional patent application claims the priority of U.S. Provisional Patent Application Ser. No. 60/424,850, filed Nov. 8, 2002, entitled "OPTIMUM UTILIZATION OF SLOT GAP IN PIFA DESIGN", incorporated herein by reference. United States Non-Provisional patent application Ser. No. 10/135,312, filed Apr. 29, 2002, entitled "SINGLE FEED TRI-BAND PIFA WITH PARASITIC ELEMENT", incorporated herein by reference, provides a parasitic element within an interior region that exists between the radiating element and the ground plane of a PIFA, this parasitic element being connected to the ground plane.

FIELD OF THE INVENTION

This application relates to receiving/transmitting radio wave antennas, for example antennas for use in wireless communication, and more specifically to planar antennas such as microstrip antennas and planar inverted-F antennas (PIFAs) that have a slot in the receiving/transmitting radiating element thereof (hereinafter called a radiating element).

BACKGROUND OF THE INVENTION

Antennas for handheld portable equipment, for example pagers, portable telephones and cellular telephones, must be small in size, light in weight, and compact in physical volume. Flush-mounted or built-in internal antennas are often required, and PIFAs are particularly attractive for applications of this type. For many installations, a PIFA is a preferred choice for use as an internal antenna in cellular communications applications.

PIFAs are so named because from a side view a PIFA having an air dielectric resembles the letter F with its face down (see for example section 10.7 of the publication MICROSTRIP ANTENNA DESIGN HANDBOOK by R. Garg, P. Bhartia, I. Bahl and A. Ittipiboon, Copyright 2001 Artech House, Inc.).

PIFA technological and design progress has led to size-miniaturization, and to the enhancement of the multi band performance of a single feed PIFA. The multi band performance capability of a single feed PIFA has also been advanced to simultaneously include both dual cellular and dual non-cellular applications.

PIFA designs can include the formation of a slot in the PIFA's radiating element. For example, U.S. Pat. No. 6,573,869, incorporated herein by reference, provides a multi-band PIFA having a radiator with a spiral slot formed therein to cause multiple frequency dependent nulls in the antenna's electric field modal distribution.

Choices of the position, contour and the length of a slot within a PIFA's radiating element depend on the design parameters of interest, and at times more than one slot is preferred within the PIFA's radiating element.

Using a slot to physical partition the radiating element of a single band PIFA for multi band operation, as well as providing a slot as a reactive loading tool to reduce the resonant frequencies of the radiating element, form two important functional roles of a slot in a PIFA's radiating element. In addition, the position and the contour of the slot can be chosen to control the polarization characteristics of the upper resonant band of a multi band PIFA.

The introduction of a slot within a PIFA's radiating element has the undesirable effect of reducing the effective surface area of the radiating element, which in turn leads to a degrading effect on both the gain and the bandwidth of the PIFA.

In addition to having a slot, the radiating element of a PIFA can also be associated with capacitive loading elements, usually in the form of bent metal segments or tabs at the edges of the radiating element, these segments extending downward toward the ground plane without touching the ground plane. However, capacitive loading has a negative impact on both the bandwidth and the gain of the PIFA. As an example, U.S. Pat. No. 5,764,190, incorporated herein by reference, provides a capacitive loaded PIFA.

Slot loading and capacitive loading are most often used to achieve a desired resonance without increasing the physical size of the PIFA.

Despite the above-mentioned shortcoming of a slot on the performance of a PIFA, the formation of a slot within the PIFA's radiating element may be necessary in order to realize multi band performance, as well as to provide a desired resonance.

Likewise, capacitive loading can be a common requirement in PIFA designs in view of severe constraints that are placed on the physical volume that is available for placement of an internal antenna within a wireless device.

As an example of the use of a meandering pattern within the radiating stricture of a PIFA, U.S. Pat. No. 6,380,895, incorporated herein by reference, provides a radiating structure for a microstrip PIFA wherein a first patch s connected to a second patch by way of a meandering pattern. The first patch comprises means for feeding an RF signal to the radiating structure, and the meandering pattern acts as an inductive connection between the two patches.

SUMMARY OF THE INVENTION

This invention provides for the optimum utilization of a gap that forms the contour of a slot in the radiating element of a PIFA in order to control the operating parameters of the PIFA. While the invention will be described for use in PIFAs, the invention is of general utility in planar antennas that have a slot in their radiating element.

In prior art PIFAs the radiating element's slot region is free from the physical presence of any portion of the PIFA's radiating element, as shown for example in FIG. 9 wherein the PIFA's generally planar and rectangular-shaped metal radiating element 90 (shown in a top view) includes a non-radiating edge 91, a radiating edge 97, a generally uniform-width L-shaped slot 92 having a short vertical segment 93 that extends generally perpendicular to non-radiating edge 91 and a long horizontal segment 94 that extends generally parallel to non-radiating edge 91, a shorting-post or region 95 on non-radiating edge 91 that extends downward from the plane of radiating element 90 to electrically connect radiating element 91 to the metal ground plane (not shown) of PIFA 90, and a feed-post or region 96 on non-radiating edge 91 that connects radiating element 90 for the reception/transmission of RF signals. The length of L-shaped slot 92 is the sum of the length of vertical slot segment 93 and horizontal slot segment 94.

In accordance with the present invention, PIFAs include a metal segment within a slot that is provided in a PIFA's metal radiating element. In accordance with the present invention this metal segment can be connected to the radiating element, to thus form an extension of the radiating element, or this metal segment can be connected to the PIFA's ground plane, to thus form a shorted parasitic element for the PIFA.

The construction and arrangement of the present invention provides for the effective utilization of the gap region that is provided by the slot, which is tantamount to increasing the effective or virtual physical dimension of the PIFA's radiating element. This virtual increase in physical dimension facilitates a reduction in the capacitive loading that is usually required in order to realize a desired resonance. A decrease in capacitive loading also improves the bandwidth or gain, or both the bandwidth and the gain, of the PIFA.

With judicious choice of the contour of the metal segment of the radiating element that extends into the radiating element's slot, it is possible to overcome entirely the capacitive loading requirement, even when there is a severe restriction on the linear dimensions of the PIFA.

In accordance with the present invention's concept of providing a metal segment within the slot of a PIFA's radiating element, one end of this metal segment within the slot can be physically connected to the radiating element, or one end of this metal segment within the slot can physically connected to the PIFA's ground plane.

Above-mentioned U.S. patent application Ser. No. 10/135,312 illustrates the generation of an exclusive resonant band by way of a shorted parasitic element that is placed in the space between a PIFA's radiating element and ground plane.

In the construction and arrangement of the present invention such an exclusive resonant band is provided wherein the radiating element and the shorted parasitic element are in a common plane. In the present invention (see FIG. 8) a shorted parasitic element is placed within the slot region of the radiating element, and the shorted parasitic is not electrically connected to the radiating element. This co-planar placement of the radiating element and the shorted parasitic element facilitates an easy of fabrication of a single feed multi band PIFA.

DETAILED DESCRIPTION

Figure 1:
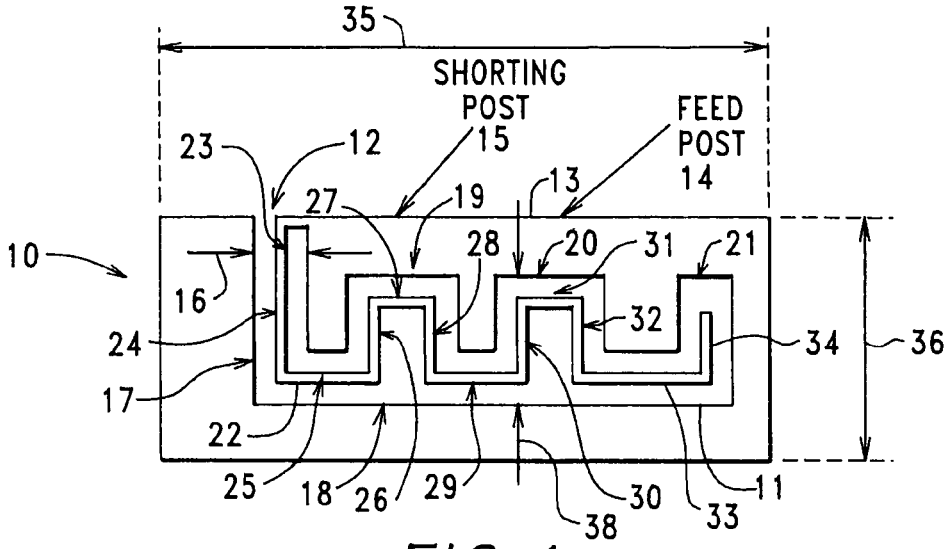
FIG. 1 is a top view of a first embodiment of the invention wherein a PIFA's planar metal radiating element includes a generally uniform width L-shaped slot having an open end that lies on the non-radiating edge of the radiating element, whose short vertical slot-segment or leg extends generally perpendicular from the radiating element's non-radiating edge and whose long horizontal slot-segment or leg meanders in a path that is generally parallel to the non-radiating edge, and wherein a meandering and generally uniform width metal extension of the radiating element is coplanar with the radiating element, enters the open end of the L-shaped slot, is generally centered within the L-shaped slot, and extends generally along the length of the L-shaped slot.

FIG. 1 illustrates a first embodiment of the invention.

Figure 10:
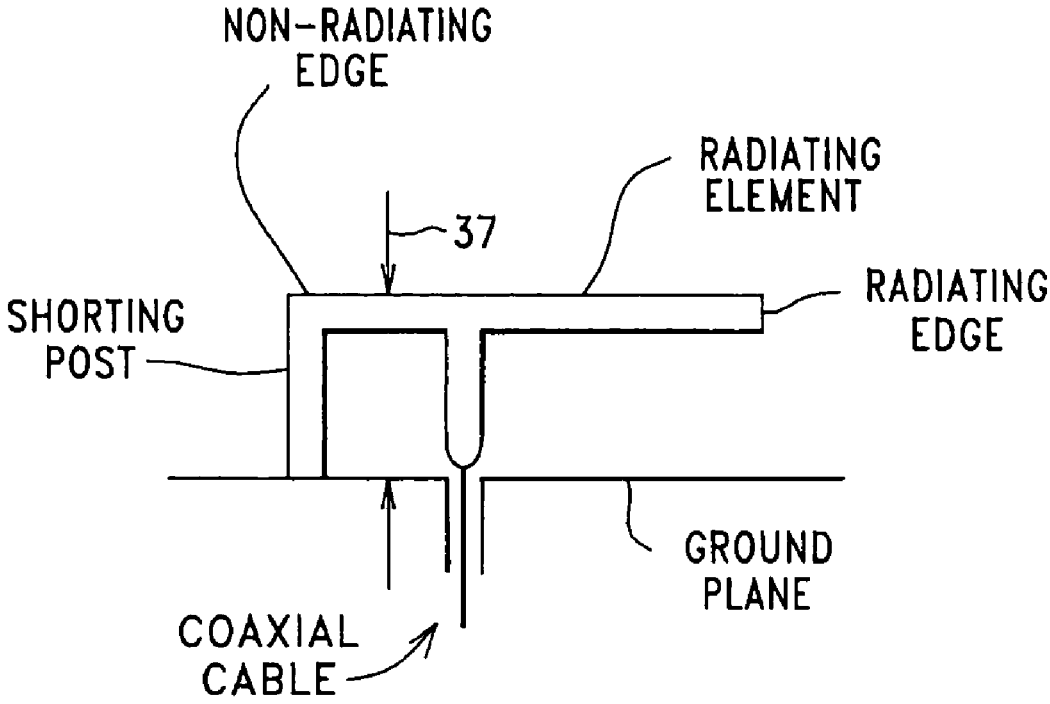
FIG. 10 (PRIOR ART)
FIG. 10 is a side view of a prior art PIFA, this view showing the inverted-F shape of a PIFA, and this view showing a metal ground plane of the type that is provided within PIFAs that are constructed and arranged in accordance with the present invention.

As with other embodiments of this invention to be described, a top view of a radiating element is shown, it being understood that the radiating element is spatially associated with a ground plane, much as is shown in prior art FIG. 10. For purposes of simplification, the ground plane that is associated with embodiments of this invention is not shown in FIGS. 1–8.

FIG. 1 is the top view of a generally flat or planar metal radiating element 10 of a PIFA constructed and arranged in accordance with this invention, radiating element 10 including a meandering-path slot 11 that is generally L-shaped. The open end 12 of L-shaped slot 11 lies on the radiating element's non-radiating edge 13, i.e. the edge of radiating element 10 that contains a downward extending shorting post or shorting area 15 whose bottom end electrically connects to the PIFA's metal ground plane (not shown). In FIG. 1, a feed post or feed area 14 is also placed on the non-radiating edge 13 of radiating element 10.

A majority of the length of L-shaped slot 11 is of a generally uniform width, as is identified by numeral 16. The vertically extending section 17 of L-shaped slot 11 is linear and extends generally perpendicular to non-radiating edge 13. The horizontally extending section 18 of L-shaped slot 11 follows a meandering path that includes three vertically extending segments 19, 20 and 21. Note that at the location of the three vertically extending segments (19,20,21), L-shaped slot 11 have a greater vertical width, as is indicated by numeral 38.

The meandered path of L-shaped slot 11 provides a loading effect that reduces the resonant frequency of radiating element 10, and this is accomplished without increasing the physical dimensions of the PIFA that contains radiating element 10.

As shown in FIG. 1, a meandering metal segment 22 of radiating element 10 is provided within L-shaped slot 11, with only the end 23 of segment 22 being connected to radiating element 11 at or near the open end 12 of L-shaped slot 11. This meandering metal segment 22 whose end 23 is connected to radiating element 11 generally follows or corresponds to the meandering path of L-shaped slot 11.

More specifically, metal segment 22 is made up of a first vertically-extending portion 24 and a second horizontally-extending portion 25, both of which are spaced generally equal distances from the adjacent walls of L-shaped slot 11.

The third, fourth and fifth portions 26, 27 and 28 of segment 22 form a vertically extending portion of segment 22 that extends upward into the vertical section 19 of L-shaped slot 11. This vertically extending portion of segment 22 is spaced generally the same equal distance from the adjacent walls of vertical section 19.

The horizontally-extending sixth portion 29 of metal segment 22 is also spaced generally the same equal distance from the adjacent walls of L-shaped slot 11.

The seventh, eighth and ninth portions 30, 31 and 32 of metal segment 22 form a vertically extending portion of segment 22 that extends upward into the vertical section 20 of L-shaped slot 11. This vertically extending portion of segment 22 is spaced generally the same equal distance from the adjacent walls of vertically extending section 20.

The horizontally-extending tenth portion 33 of segment 22 is also spaced generally the same equal distance from the adjacent walls of L-shaped slot 11.

The eleventh portion 34 of metal segment 22 extends vertically upward into the vertical section 21 of L-shaped slot 11 and this portion of segment 22 is also spaced generally the same equal distance from the adjacent walls of vertical section 21.

The meandered path of the metal segment 22 that lies within L-shaped slot 11 also provides the effect of virtually increasing the linear (length and width) dimensions of a PIFA that contains radiating element 10.

This construction and arrangement of the present invention whereby a portion or segment 22 of radiating element 10 is extended into L-shaped slot 11 is useful in the design of PIFAs that resonate in the AMPS band. As an example, such a radiating element 10 has a width 35 of about 33 mm and a length 36 of about 13 mm, the height of the PIFA was about 4.5 mm (see dimension 37 of FIG. 10), and the PIFA's ground plane had a width of about 35 mm and a length of about 75 mm.

The semi-perimeter of such an AMPS-band PIFA having the above dimensions is only about 46 mm, as compared to a semi-perimeter of about 87.31 mm for a conventional AMPS band PIFA whose radiating element is devoid of the above-described slot and metal segment, and of capacitive loading elements.

That is, a significant miniaturization in the overall size of a PIFA results when one uses the present invention.

Figure 2:
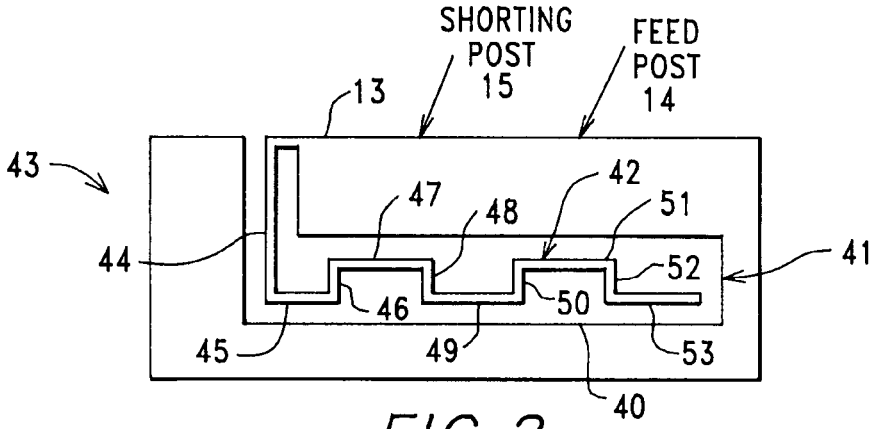
FIG. 2 is a top view of a second embodiment of the invention that is somewhat similar to FIG. 1 wherein the PIFA's planar metal radiating element includes a generally L-shaped and uniform width slot whose open end is on the non-radiating edge of the radiating element, wherein the horizontal segment of the slot is linear, wherein a meandering metal extension of the radiating element is coplanar with the radiating element, wherein the metal extension of the radiating element enters the open end of the L-shaped slot, is generally centered within and extends generally along the length of the L-shaped slot.

In FIG. 2 the above-described embodiment of FIG. 1 is modified in that the horizontal section 40 of L-shaped slot 41 is linear, i.e. it is devoid of a meandering path. However, the metal segment 42 of metal radiating element 43 that extends the along length of the horizontal section 40 of L-shaped slot 41 follows a meandering path, this path being similar to the above-described path of metal segment 22 that is shown in FIG. 1.

More specifically, in FIG. 2, metal segment 42 includes a first portion 44 that extends generally perpendicular to the non-radiating edge 13 of radiating element 43, a second portion 45 that extends generally parallel to non-radiating edge 13, a third portion 46 that extends generally perpendicular to non-radiating edge 13, a fourth portion 47 that extends generally parallel to non-radiating edge 13, a fifth portion 48 that extends generally perpendicular to non-radiating edge 13, a sixth portion 49 that extends generally parallel to non-radiating edge 13, a seventh portion 50 that extends generally perpendicular to non-radiating edge 13, a eighth portion 51 that extends generally parallel to non-radiating edge 13, a ninth portion 52 that extends generally perpendicular to non-radiating edge 13, and a tenth portion 53 that extends generally parallel to non-radiating edge 13.

Figure 3:
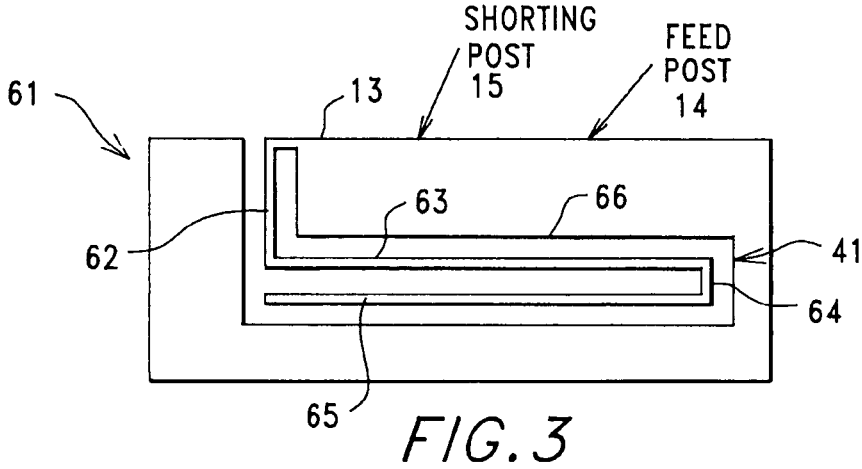
FIG. 3 is a top view of a third embodiment of the invention that is somewhat similar to FIGS. 1 and 2, wherein a PIFA's planar metal radiating element includes a generally L-shaped and uniform width slot whose open end lies on the non-radiating edge of the radiating element, wherein a metal extension of the radiating element that is coplanar with the radiating element enters the open end of the L-shaped slot, extends generally along the length of the L-shaped slot, and then turns 360 degrees to extend back along the length of the horizontal segment of the L-shaped slot.

The embodiment of the invention that is shown in FIG. 3 differs from the above-described FIG. 2 embodiment in that the metal segment that lies within the L-shaped slot 41 that is provided within radiating element 61 follows a modified type of meandering path. This lack of a multi-turn meandering path as above-described relative to FIGS. 1 and 2 is compensated for by providing a longer overall linear length for metal segment, as is shown in FIG. 3.

More specifically, the metal segment that is coplanar with radiating element 61 includes a first portion 62 that extends generally perpendicular to non-radiating edge 13, a second portion 63 that extends generally parallel to non-radiating edge 13 and generally the entire length of the slot's horizontal segment 66, a third turn-around portion 64 that extends generally perpendicular to non-radiating edge 13, and a fourth portion 65 that extends generally parallel to non-radiating edge 13 and generally the entire length of the slot's horizontal segment 66.

Figure 4:
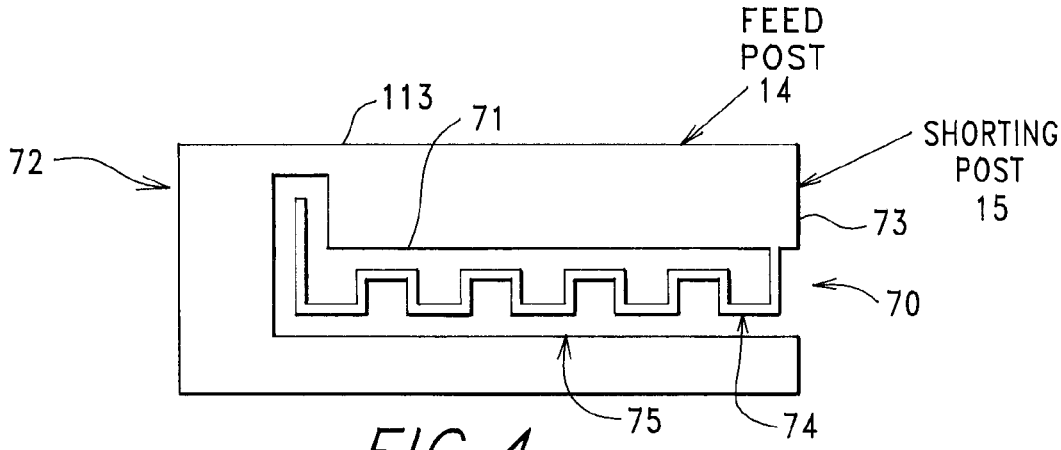
FIG. 4 is a top view of a fourth embodiment of the invention wherein a PIFA's planar metal radiating element includes a generally L-shaped slot whose horizontal segment extends generally parallel to the non-radiating edge of the radiating element, whose vertical segment provides an open end on a side edge of the radiating element, and wherein a meandering metal extension of the radiating element enters the open end of the L-shaped slot, is generally centered within, and extends generally along the length of the L-shaped slot.

FIG. 4 provides yet another embodiment of the invention wherein the metal radiating element's feed post 14 and shorting post 15 are in a mutually orthogonal disposition. That is, feed post 14 is located on the radiating edge 113 of radiating element 72, and shorting post 15 is located on a side edge (non-radiating edge) 73 of radiating element 72.

Also, both the shorting post 15 and the open end 70 of the L-shaped slot 71 that is within radiating element 72 are located on the narrow side edge (non-radiating edge) 73 of a PIFA's radiating element 72. Note that in FIG. 4, non-radiating edge 73 extends along the narrow dimension of radiating element 72.

FIG. 4's L-shaped slot 71 is generally similar to FIG. 2's L-shaped slot 41, with the exception that the slot's open end 70 lies on the narrow dimension of radiating element 72.

As was true of the above-described embodiments of the invention, the metal segment 74 that lies within L-shaped slot 71 is connected to radiating element 72 at or near the open end 70 of L-shaped slot 71.

As was above-described relative to FIG. 2, metal segment 74 is coplanar with radiating element 72 and metal segment 74 follows a path that meanders along the horizontal segment of generally L-shaped slot 71 that is within radiating element 72.

The orthogonal disposition of feed post 14 and shorting post 15, as well as the placement of the open end 70 of L-shaped slot 71 along the narrow dimension of radiating element 72 has been used in the design of an AMPS band PIFA having a radiating element 72 with a width of about 33 mm and a length of about 13 mm, above a ground plane having a width of about a 35 mm and a length of about 75 mm, with the height of the PIFA being about 4.5 mm.

In the previous embodiments of the invention as shown in FIGS. 1–4, a single metal segment is provided within the slot region of a PIFA's metal radiating element, and this metal segment is formed as an extension of the radiating element.

Figure 5:
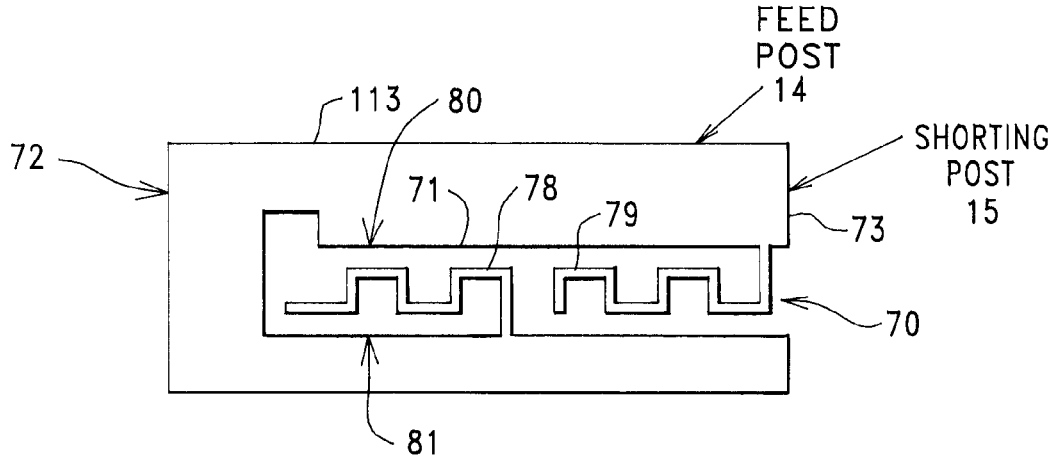
FIG. 5 is a top view of a fifth embodiment of the invention that is somewhat similar to FIG. 4 wherein the horizontal segment of generally L-shaped slot includes two generally uniform width meandering extensions of the radiating element, these two extensions generally equally dividing the horizontal segment of the L-shaped slot.

FIG. 5 provides an embodiment of the invention in which two separate metal segments 78 and 79 are provided within the generally L-shaped slot 71 that is formed in the radiating element 72 of the PIFA. These two metal segments 78 and 79 are connected to radiating element 72 at the opposite sides 80 and 81 of the horizontal segment of L-shaped slot 71.

The formation of the two separate metal segments 78 and 79 within slot 71, to thus form two extensions of radiating element 72, provides an additional degree of freedom in the design of a PIFA. The overall horizontal length of the each of the two metal segments 78 and 79 appears to provide opposite effects in controlling the resonant frequency of the PIFA.

An AMPS band PIFA having a width of about 33 mm, a length of about 13 mm, and a height of about 4.5 mm, with a metal ground plane having a width of about 35 mm and a length of about 75 mm, has been constructed utilizing the FIG. 5 embodiment of the invention, and this PIFA did not require capacitive loading elements, which in turn implies the absence of the need to bend radiating element 72 along some of its edges, downward toward the ground plane.

Figure 6:
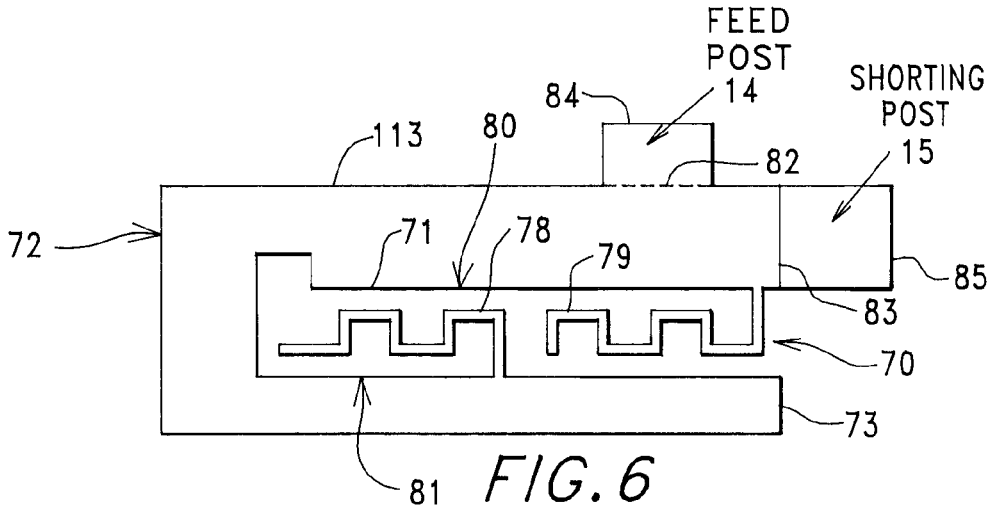
FIG. 6 is a top view of a sixth embodiment of the invention that is similar to FIG. 5 wherein a relatively long metal shorting post on the radiating element's side edge and a relatively short metal feed post on the radiating element's radiating edge are provided as coplanar portions of the radiating element, this figure also showing by way of dotted lines how the shorting post and the feed post are bent generally 90 degrees downward from the plane of the radiating element, toward the PIFA's metal ground plane (not shown), the length of the shorting post spanning the distance between the radiating element and the ground plane to thereby electrically connect the side edge of the radiating element to the ground plane.

The composite assembly of the PIFA's radiating element 72 as shown in FIG. 5 is shown in FIG. 6 with its feed post 14 and its shorting post 15 wherein dotted lines 82 and 83 show the locations whereat feed post 14 and shorting post 15 are bent downward, so that the end 84 of feed post 14 is located above the PIFA's ground plane, and the end 85 of shorting post 85 physically engages and is electrically connected to the ground plane.

As with other embodiments of this invention, the composite assembly shown in FIG. 6 is ideal for formation using either through two shot molding or metal plated plastic techniques, and this composite assembly can also be formed on a flex board of the type normally used for a meander-line type of antenna.

The PIFA design embodiments of this invention shown in FIGS. 1–6 involve the use of a single L-shaped slot within the PIFA's radiating element. In a single feed, dual band, PIFA this single L-shaped slot configuration may have disadvantages, such as the lack or difficulty of independent tuning control of the lower and upper resonant bands.

Figure 7:
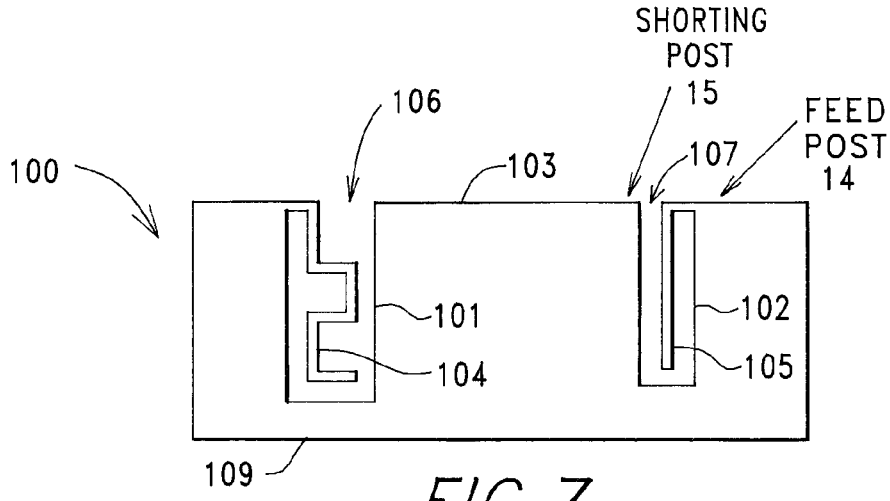
FIG. 7 is a top view of a seventh embodiment of the invention wherein the PIFA's planar radiating element includes two generally linear slots that extend generally perpendicular from the non-radiating edge of the radiating element, with the open ends of the two slot being spaced from each other along the non-radiating edge, wherein a first slot includes a meandering extension of the radiating element that is coplanar with the radiating element and is generally centered in the first slot, and wherein a second slot includes a linear extension of the radiating element that is coplanar with the radiating element and is generally centered in the second slot.

In the embodiment of the invention shown in FIG. 7 the configuration of a PIFA's radiating element 100 is shown wherein two linear or straight slots 101 and 102 extend generally perpendicular from the radiating element's non-radiating edge 103, this non-radiating edge also containing a shorting post 15 and a feed post 14. This embodiment of the invention provides the advantage of a relatively independent control in the tuning of the lower and upper resonant bands of the single feed PIFA.

The length of the two individual slots 101,102, and the position of these two individual slots along non-radiating edge 103, provide a tuning effect on only one particular resonant band, leaving the other resonant band almost unaffected.

The above-described inventive concept of providing a meandering metal radiating element segment 104 within linear slot 101, and providing a linear metal radiating element segment 105 within linear slot 102, both of which act as an extension of radiating element 100, can also be extended to dual band or multi band PIFA designs having more than one slot in the radiating element.

The single feed multi band PIFA of FIG. 7 provides all the new and unusual qualities of the FIGS. 1–6 embodiments of the invention, and in addition, the PIFA embodiment of FIG. 7 provides the desirable feature of relatively independent control in the tuning of the PIFA's lower and upper frequency bands by the choices of the position and the size of slot 101 and 102.

The profile and length of the metal radiating element segments 104 and 105 that are formed within the individual slots 101 and 102 influence only a respective resonant band.

The paths that segments 104 and 105 follow within the two slots 101 and 102 can be similar or dissimilar. That is, the path of the metal segment in each of the two slots 101,102 can be linear or meandering, or the path can be a combination both a linear and a meandering type.

Further, in FIG. 7, the open ends 106 and 107 of the two slots 101 and 102 are shown to be on the non-radiating edge 103 of the PIFA's radiating element 100. However, this not a requirement. That is, it is possible to provide two slots whose open ends are on the opposite and parallel edges 103 and 109 of radiating element 100.

Further, the embodiment of the invention shown in FIG. 7 can include a modification wherein the two straight slots 101 and 102 can be replaced by a two-slot combination such as an L-shaped slot and a straight slot, or two L-shaped slots.

Figure 8:
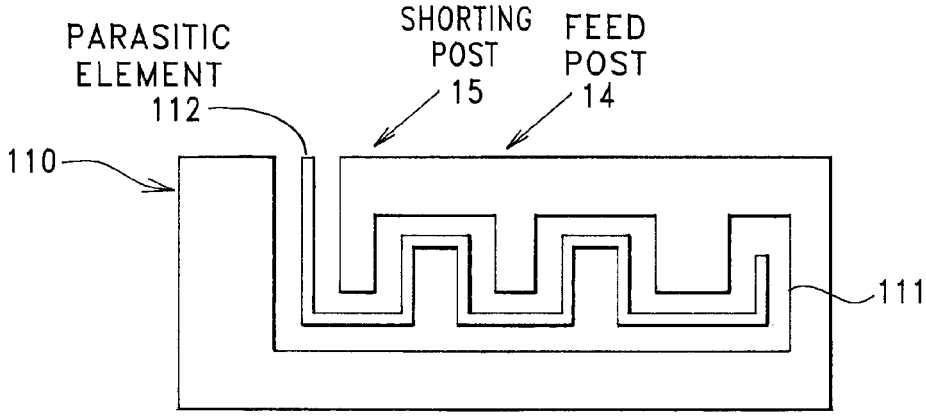
FIG. 8 is a top view of an eight embodiment of the invention that is somewhat similar to FIG. 1, the difference being that the coplanar metal pattern that meanders along the center of the L-shaped slot is electrically connected to the PIFA's metal ground plane, to thus form a shorted parasitic element.
Figure 9:
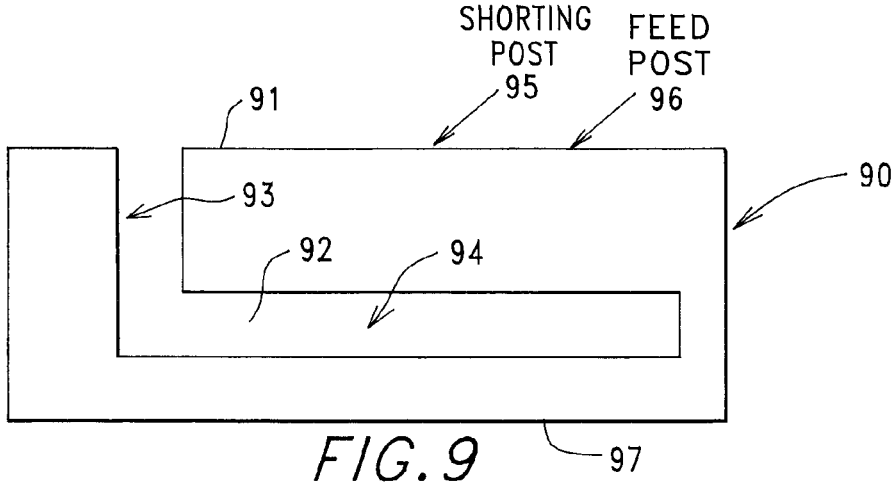
FIG. 9 (PRIOR ART)
FIG. 9 is a top view of a prior art radiating element of a PIFA wherein a generally L-shaped slot is formed in the radiating element such that the vertical segment of the slot extends generally perpendicular to the non-radiating edge of the radiating element, and such that the horizontal segment of the slot extends generally parallel to the non-radiating edge of the radiating element.

In the embodiment of the invention shown in FIG. 8, the metal radiating element 110 of a single feed tri band or multi band PIFA is shown.

In FIG. 8, the size of radiating element 110, the position of feed post 14, the position of shorting post 15, the size of the PIFA's metal ground plane, the position and the size of meandering L-shaped slot 111, and the height of the PIFA (i.e. the distance between radiating element 110 and the ground plane) determine the PIFA's dual resonant frequencies.

An additional resonant frequency of the PIFA of FIG. 8 is also realized by forming a meandering metal segment 112 within meandering L-shaped slot 111. In this embodiment of the invention metal segment 112 is connected to the PIFA's ground plane, to thus perform as a shorted parasitic element.

The length of shorted parasitic element 112 can be adjusted to realize a desired additional resonant band of practical interest (such GPS or Bluetooth).

The formation of shorted parasitic element 112 within the generally L-shaped slot 111 of a dual band PIFA may de-tune the prior resonant characteristics of the PIFA. Re-optimizing radiating element 110 may be required to re-gain the prior achieved dual resonance characteristics of the PIFA. Often, an iterative design cycle comprising alternate turns in tuning radiating element 110 and shorted parasitic element 112 may be warranted in order to realize a desired dual resonance of the PIFA, and in order to retain the required additional resonance that is provided by parasitic element 112.

In describing this invention, when placing an extension of the radiating element into the radiating element's slot region it has been assumed that the extension was co-planar with the radiating element. This co-planarity provides for the desirable advantage of a relative ease of fabricating the radiating element.

However, the concept of extending the radiating element into the slot region of a radiating element, or the concept of placing a separate shorted parasitic element into the slot region of a radiating element, can be implemented without requiring this co-planarity.

In such a generalized scenario, only a segment or a part of the extension of the radiating element need extend into or through the slot region so as to be co-planar with the radiating element, and the reminder of the extension can extend into the space that is available between the radiating element and the ground plane of a planar antenna such as a PIFA or a microstrip antenna, for example see the air-dielectric space that exists in FIG. 10 between the radiating element and the ground plane. Implementation of such a generalized design requires only an area of the slot region that facilitates a continuation of the co planar segment of the extension of the radiating element into the space that exists between the radiating element and the ground plane. With a view to keeping the description of this invention concise, and with a view to avoiding repetition, no further detailed description is required of embodiments of the invention wherein the metal element that lies within the radiating element's slot includes a portion that is within the space the exists between the radiating element and the ground plane.

While the invention has been described in detail above, it is intended that this detailed description should not be a limitation on the spirit and scope of this invention.

The invention claimed is:

1. An antenna, comprising:

a ground plane;

a radiating element spaced above said ground plane having an edge;

a slot having side walls formed in said radiating element, the slot having an open end located on said edge and having a closed end located within said radiating element, the slot including at least a first portion that extends generally perpendicular to said edge and a second portion that extends generally parallel to said edge;

a shorting post connecting said radiating element to said ground plane; and an extension of said radiating element where at least one part of the extension resides in the same plane as said radiating element and out of physical contact with said side walls, said extension having a first end connected to said radiating element and located generally adjacent to said open end of said slot and having a second end located generally adjacent to said closed end of said slot, wherein said extension includes at least a first portion that extends through said first portion of said slot, and wherein said extension includes at least a second portion that extends through said second portion of said slot.

2. The antenna of claim 1 wherein a portion of said extension is located in a space between said radiating element and said ground plane.

3. The antenna of claim 1 wherein said second end of said extension is located in a space between said radiating element and said ground plane.

4. The antenna of claim 1 wherein said edge is a non-radiating edge of said radiating element.

5. The antenna of claim 4, wherein said shorting post is located generally on said non-radiating edge of said radiating element.

6. The antenna of claim 5 including:

a feed post on a non-radiating edge.

7. The antenna of claim 1 wherein said edge is a radiating edge of said radiating element and including a feed post on said radiating edge.

8. The antenna of claim 1 wherein said edge is a generally linear edge, wherein said slot is a generally L-shaped slot, and wherein the first portion extends generally perpendicular to said linear edge and the second portion extends generally parallel to said linear edge.

9. The antenna of claim 8 wherein said second portion of said extension additionally extends into a space between said radiating element and said ground plane.

10. The antenna of claim 8 wherein said second portion of said slot meanders in a path that extends generally parallel to said generally linear edge, and wherein said second portion of said extension meanders in a path that extends generally parallel to said generally linear edge.

11. The antenna of claim 10 wherein said second portion of said extension additionally extends into a space between said radiating element and said ground plane.

12. The antenna of claim 8 wherein said second portion of said slot is a linear portion that extends generally parallel to said generally linear edge, and wherein said second portion of said extension includes a first portion that extends in one direction through said second portion of said slot, a turn-around portion that is located generally at said closed end of said slot, and a third portion that extends in a second direction through said second portion of said slot.

13. The antenna of claim 1 wherein said edge is a non-radiating edge of said radiating element, including:

a radiating edge on said radiating element;

a feed post on said radiating edge;

the shorting post on said non-radiating edge connecting said radiating element to said ground plane;

said slot having the open end located on said non-radiating edge and the closed end located within said radiating element;

said extension having the first end connected to said radiating element generally at said open end of said slot; and said extension having the second end located generally adjacent to said closed end of said slot.

14. The antenna of claim 13 wherein said slot includes a generally linear portion that extends generally perpendicular to said non-radiating edge, and wherein said extension follows a meandering path as it extends through said linear portion of said slot.

15. The antenna of claim 14 wherein said slot includes a first generally linear portion that extends generally perpendicular to said non-radiating edge and a second generally linear portion that extends from said first portion of said slot generally parallel to said non-radiating edge, wherein said extension includes a first portion that follows a meandering path as it extends though said first linear portion of said slot, and wherein said extension includes a second portion that extends from said first portion of said extension and follows a generally linear path as it extends through said second portion of said slot.

16. The antenna of claim 1 wherein said edge is a non-radiating edge of said radiating element, including:

a radiating edge on said radiating element;

a feed post on said radiating edge;

the shorting post on said non-radiating edge connecting said radiating element to said ground plane;

said slot having the open end located on said non-radiating edge and the closed end located within said radiating element;

said extension having a first portion connected to said radiating element generally adjacent to said open end of said slot so as to position a second end of said first portion generally at a middle of a length of said slot; and said extension having a second portion having a first end connected to said radiating element adjacent to said second end of said first portion, said second portion having a second end located generally adjacent to said closed end of said slot.

17. The antenna of claim 16 wherein said first and second portions of said extension follow meandering paths.

18. The antenna of claim 1 wherein said antenna is a planar antenna selected from the group of microstrip antenna and planar inverted-F antenna.

19. An antenna comprising:

a metal ground plane;

a metal radiating element spaced from said ground plane, wherein said ground plane and said radiating element are planar members that extend generally parallel to each other;

a slot having side walls farmed in said radiating element; and a metal element located within said slot where at least one part of the metal element resides in the same plane as said metal radiating element and out of physical contact with said side walls, and wherein at least a portion of said metal element is generally coplanar with said radiating element, said radiating element includes an edge, wherein said slot includes a length dimension, a closed end that is located within said radiating element, and an open end that is located on said edge, and wherein said metal element meanders generally along the length of said slot so as to have an effective length dimension that is longer than said length dimension of said slot.

20. The antenna of claim 19 wherein said metal element is connected to said ground plane.

21. The antenna of claim 19 wherein a portion of said metal element lies in a space between said radiating element and said ground plane.

22. The antenna of claim 19 including:

a shorting post connecting said radiating element to said ground plane.

23. The antenna of claim 19 wherein said metal element is connected to said radiating element.

24. The antenna of claim 19 wherein a portion of said metal element lies in a space between said radiating element and said ground plane.

25. The antenna of claim 24 wherein said radiating element includes an edge, wherein said slot includes a length dimension, a closed end that is located within said radiating element, and an open end that is located on said edge, and wherein said metal element meanders generally along said length dimension of said slot so as to have an effective length dimension that is longer than said length dimension of said slot.

26. The antenna of claim 25 including:

a shorting post connecting said radiating element to said ground plane.

27. The antenna of claim 19 wherein said antenna is selected from the group of microstrip antenna and planar inverted-F antenna.

* * * * *